US009221164B2

(12) United States Patent
Schneider et al.

(10) Patent No.: US 9,221,164 B2
(45) Date of Patent: Dec. 29, 2015

(54) CHISEL

(71) Applicant: Hilti Aktiengesellschaft, Schaan (LI)

(72) Inventors: Jens Schneider, Feldkirch (AT); Karsten Brandenburg, Feldkirch-Tisis (AT); Zsolt Kosa, Kecskemet (HU); Lajos Toth, Kecskemet (HU)

(73) Assignee: HILTI AKTIENGESELLSCHAFT, Schaan (LI)

( * ) Notice: Subject to any disclaimer, the term of this patent is extended or adjusted under 35 U.S.C. 154(b) by 128 days.

(21) Appl. No.: 13/768,736

(22) Filed: Feb. 15, 2013

(65) Prior Publication Data

US 2013/0205603 A1 Aug. 15, 2013

(30) Foreign Application Priority Data

Feb. 15, 2012 (DE) ..... 10 2012 202 300

(51) Int. Cl.
*B25D 17/02* (2006.01)
*B25D 3/00* (2006.01)

(52) U.S. Cl.
CPC *B25D 17/02* (2013.01); *B25D 3/00* (2013.01); *B25D 2250/211* (2013.01); *B25D 2250/305* (2013.01)

(58) Field of Classification Search
CPC ..... B25D 1/00; B25D 1/08; B25D 1/12; B25D 17/02; B25D 2217/00; B25D 2217/0003; B25D 2217/0007; B25D 3/00; B25D 2250/211; B25D 2250/305
USPC ..... 30/167, 167.1, 355; 125/36, 40, 41
See application file for complete search history.

(56) References Cited

U.S. PATENT DOCUMENTS

| | | | | |
|---|---|---|---|---|
| 523,095 | A * | 7/1894 | Young | 125/40 |
| 2,028,993 | A * | 1/1936 | Pollard | 30/168 |
| 2,629,588 | A * | 2/1953 | Neamand | 299/100 |
| 3,163,865 | A * | 1/1965 | Zetzer et al. | 227/147 |
| 4,144,868 | A * | 3/1979 | Heitbrink | 125/41 |
| 5,730,231 | A * | 3/1998 | Racodon | 173/162.2 |
| 5,984,596 | A * | 11/1999 | Fehrle et al. | 408/226 |
| 6,076,431 | A * | 6/2000 | Vasudeva | 81/44 |
| 2003/0221685 | A1 * | 12/2003 | Lang et al. | 125/41 |
| 2004/0035595 | A1 * | 2/2004 | Fisher | 173/205 |
| 2004/0069292 | A1 * | 4/2004 | Szendrovari et al. | 125/41 |

(Continued)

FOREIGN PATENT DOCUMENTS

| | | | |
|---|---|---|---|
| CN | 201922428 | U | 8/2011 |
| DE | 466471 | C | 10/1928 |
| DE | 1846211 | | 2/1962 |
| DE | 2730596 | A1 | 7/1977 |
| WO | 9740965 | A1 | 11/1997 |

OTHER PUBLICATIONS

DE Communication, Application No. 10201220300.3 (17 pages).

(Continued)

*Primary Examiner* — Ned Landrum
*Assistant Examiner* — Richard Crosby, Jr.
(74) *Attorney, Agent, or Firm* — McAndrews, Held & Malloy, Ltd

(57) ABSTRACT

A chisel according to the present technology has a reduced tendency to jam in a substrate. The chisel is on an axis in the striking direction with successively a striking surface, a shank, a spreading element and a tip. The spreading element has multiple ribs around the axis extending along the axis 2. The ribs each have a wave shape formed through a tangential deflection with respect to the axis.

21 Claims, 4 Drawing Sheets

(56) References Cited

U.S. PATENT DOCUMENTS

| | | | | |
|---|---|---|---|---|
| 2006/0196056 | A1* | 9/2006 | Davis | 30/167 |
| 2011/0047803 | A1* | 3/2011 | Su | 30/277 |
| 2012/0020751 | A1 | 1/2012 | Bhat | |
| 2012/0301238 | A1* | 11/2012 | Quinn et al. | 408/199 |

OTHER PUBLICATIONS

DE Office Action, Nov. 2, 2012, (5 pages).
Office Action in CN 201310037374.6 dated Sep. 2, 2015.

* cited by examiner

CHISEL

CROSS-REFERENCE TO RELATED APPLICATIONS

The present application claims priority to German Patent Application DE 10 2012 202 300.3, filed Feb. 15, 2012, and entitled "Meiβeln" ("Chisel"), which is hereby incorporated by reference in its entirety.

TECHNICAL FIELD

At least some embodiments of the present invention relate to a chisel, particularly a hand-held machine tool, namely a chisel to divide a substrate into a plurality of fragments.

BACKGROUND OF THE INVENTION

Chisels are often used to divide a substrate into a plurality of fragments. To do this, the user places the chisel against the substrate. The chisel first penetrates the substrate along its axis. The chisel forces out material by producing compressive stresses. When these stresses exceed the resilience of the substrate, the latter breaks up around the chisel. However, when the substrate is able to withstand the stresses, the chisel can become stuck in the substrate. When this occurs, great physical effort may be required to remove pull the chisel out of the substrate.

BRIEF SUMMARY OF THE INVENTION

Aspects and embodiments of the present technology relate to a chisel that has a reduced tendency to jam in the substrate. The chisel has a striking face, a shank, a spreading element, and a tip arranged in succession on an axis in the direction of striking. The spreading element has a plurality of ribs extending along the axis and distributed around the axis. Each of the ribs is wave-shaped having a tangential deflection with respect to the axis. The tangential deflection is vertical to the radial direction and vertical to the axis. The tangential deflection can be curved, e.g., circular along a circumferential direction around the axis or straight along a tangent to the circumferential direction, or a combination of circular and linear deflection. Unlike a helix, the resultant waveform means that the rib is alternately deflected about the axis, first in a circumferential direction and then contrary to the circumferential direction. The alternating deflection results in shear stress in the substrate, which reduces the tendency of the chisel to jam.

According to some embodiments, the amplitude of the deflection may be limited. The amplitude is the distance between two successive deflection extremes. In some embodiments, the amplitude of the deflection may be less than the width of the rib. In some embodiments, the amplitude of a deflection in a circumferential direction about the axis can be equal to an amplitude of the deflection contrary to the circumferential direction. In some embodiments, the deflection can be between about 5 degrees and about 20 degrees.

According to some embodiments, at least one of the ribs may be deflected parallel to itself in a circumferential direction about the axis through the tangential wave-shaped deflection. In some embodiments, the rib has a cross-sectional plane perpendicular to the axis that changes continuously along the axis.

According to some embodiments, at least one of the ribs can be rotated around the axis in a circumferential direction through the tangential wave-shaped deflection. A cross-sectional plane perpendicular to the axis along the axis is rotated alternately in the circumferential direction and contrary to the circumferential direction while maintaining its shape.

The deflection causes an inclination of the rib with respect to the axis. The inclination may vary in synchronism with the waveform. The inclination is advantageous in order to prevent jamming. On the other hand, a quantitatively large inclination represents a hindrance to high breaking efficiency. The periodically changing angle extending along the axis has a minimum and maximum value. In some embodiments, the minimum value may be in the range between about −20 degrees and about −3 degrees while the maximum value may be in the range between about 3 degrees and about 20 degrees.

In some embodiments, the chisel has at least three wave trains.

BRIEF DESCRIPTION OF VIEWS OF THE DRAWINGS

Identical or functionally identical elements are identified by the same reference numerals in the figures, unless otherwise stated.

DETAILED DESCRIPTION

Various examples of embodiments of the present technology will be described more fully below with reference to the figures, in which examples of embodiments are shown. The embodiments are not intended to necessarily illustrate the invention comprehensively. Rather, the figures are given in a schematic and/or mildly out-of-scale form, where it serves the purpose of clarification. With regard to expansion of the teaching, which is directly recognizable in the figures, this can be found in the relevant prior art. In this case, it must be noted that numerous modifications and changes regarding the form and the detail of an embodiment can be undertaken without deviating from the general idea of the invention. The features of the invention disclosed in the description, the figures, and the claims can be essential for the implementation of the invention either individually or in any and all combinations thereof. In addition, all combinations of at least two features disclosed in the description, in the figures, and/or in the claims fall within the scope of the invention. The general idea of the invention is not restricted to the exact form or detail of the preferred embodiments shown and described below, or restricted to a subject matter, which would be limited compared to the subject matter claimed in the claims. Where measurement ranges are given, values lying inside the named boundaries are hereby disclosed as threshold values, and can be used and claimed in any manner. For simplicity, the same reference numbers are used for identical or similar parts, or parts with identical or similar functions.

Figure 1:
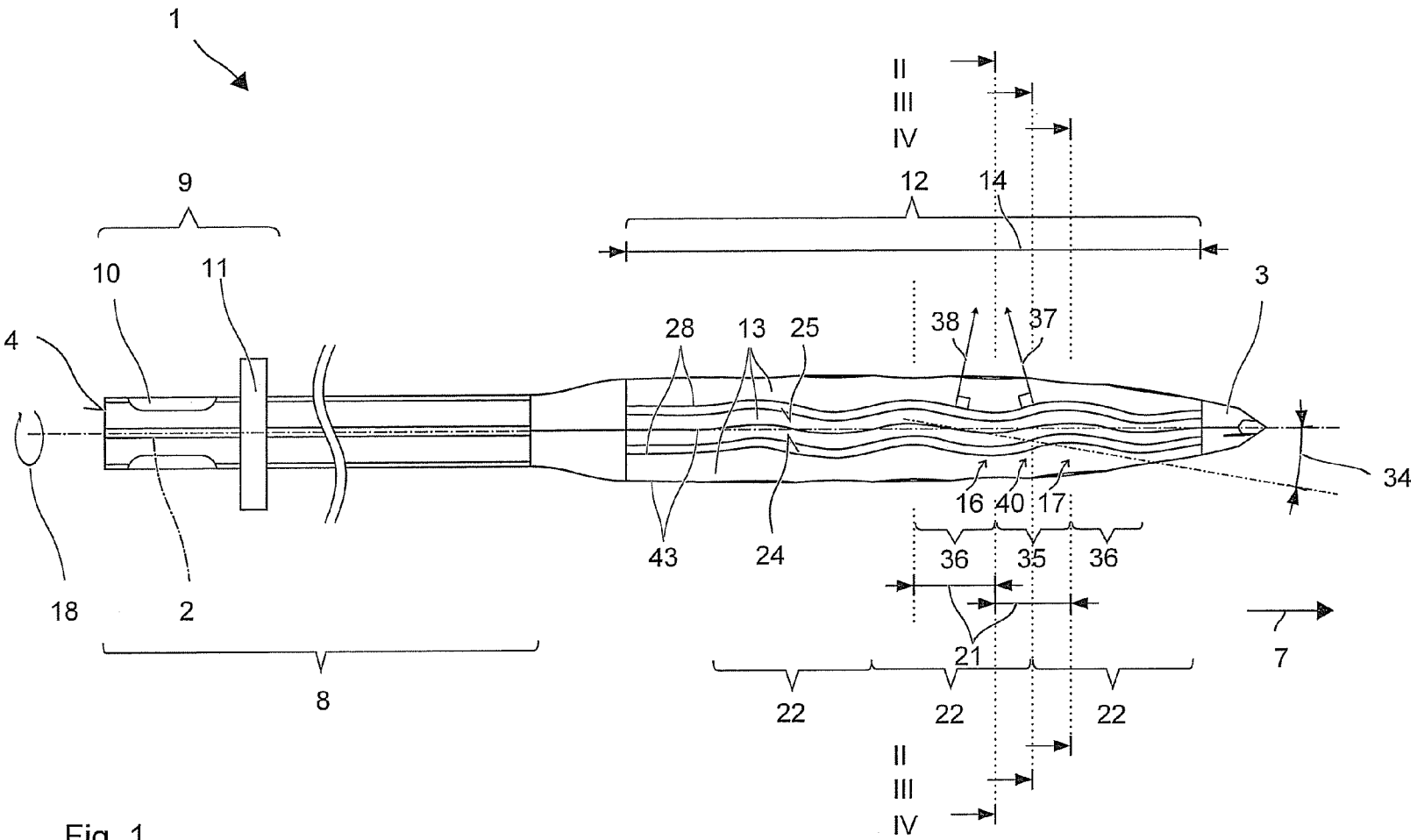
FIG. 1 shows a chisel according to certain embodiments of the present technology.

FIG. 1 shows a side view of an exemplary chisel 1 according to certain aspects of the present technology. The chisel 1 has a tip 3 at one end and a striking surface 4 at the opposite end on the same axis 2. A blow exerted on the striking surface 4 by a striking element 5, 56 of a hand-held power tool 6 is transferred to the tip 3 from the striking surface 4 in the striking direction 7 along the axis 2.

The striking face 4 is formed by the front side of a shank 8 of the chisel 1. The front side is oriented substantially perpendicularly to the axis 2, and may for example be spherical or planar in shape. The shaft 8 that is preferably formed coaxially with the axis 2. The shaft may have any of a variety of cross-sectional shapes, such as prismatic, e.g., hexagonal, or cylindrical, e.g., circular. A portion of the shank 8 immediately adjacent to the striking face 4 can be designed as an insertion end 9 for a hammer drill 6 or a hammer chisel. For example, groove-shaped depressions 10 can be provided in the shank 8 along the axis 2, which can engage in locking elements of the hand-held power tool 6. Alternatively or additionally, an annular collar 11 may be provided on the shank 8. The radially projecting collar 11 may be engaged from behind by a bracket of the hammer drill 6 in order to axially secure the chisel 1.

The tip 3 narrows in the striking direction 7 and may be symmetrical about the axis 2. For example, the tip 3 may be pyramidal or conical.

A spreading element 12 is arranged on the axis 2 between the tip 3 and the shank 8. The spreading element functions to reduce the risk of the chisel becoming jammed or stuck in a substrate. The spreading element 12 may be constructed from the same material as the whole of the tip 3. One suitable material is steel.

Figure 4:
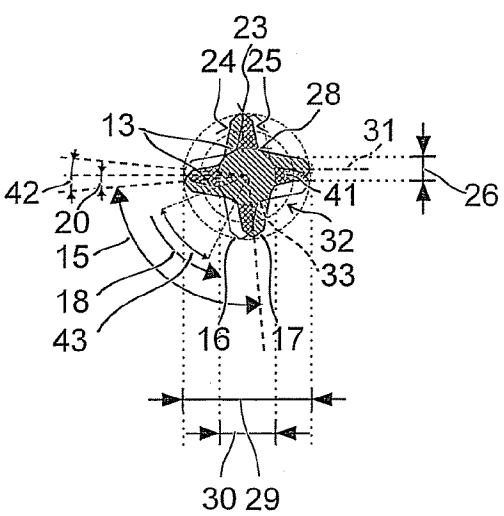
FIGS. 2, 3 and 4 show cross-sections through the chisel in the planes II-II, III-III and IV-IV of FIG. 1.
Figure 3:
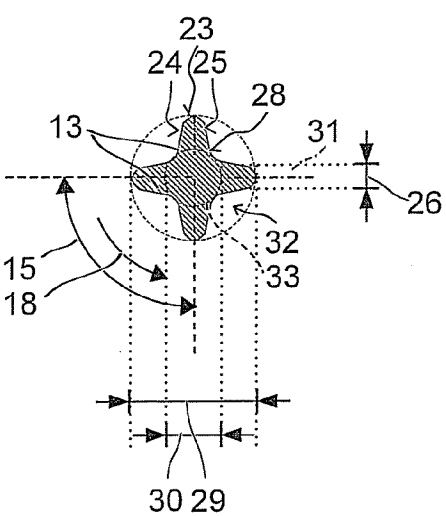
Figure 2:
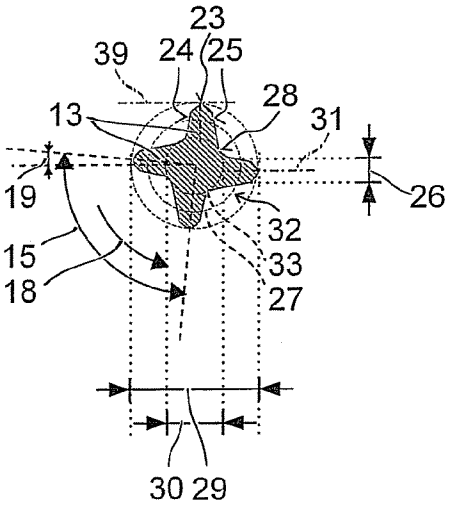

FIG. 2 shows a cross-section through the exemplary spreading element 12 in the plane II-II, while FIG. 3 shows a cross-section in the plane III-III and FIG. 4 shows a cross-section in the plane IV-IV. The plane III-III lies in the middle between the planes II-II and IV-IV. The exemplary rod-shaped spreading element 12 has a plurality of ribs 13 extending longitudinally along the shank 2, and arranged around the axis 2. The ribs 13 may all begin from the tip 3. Their lengths (measured along the axis 2) can be the same and, in particular, equal to the length 14 of the spreading element 12. The ribs 13 may be disposed around the axis 2 at equidistant angles 15. In the exemplary embodiment shown, the ribs 13 are identical and arranged in parallel.

The ribs 13 are wave-shaped with a changing deflection that is tangential to the axis 2. Characteristic of the waveform are local minima 16 and maxima 17 of the deflection, which occur along the axis 2. Starting from a minimum 16 and running in the striking direction 7, the deflection of the rib 13 increases continuously in the circumferential direction 18 to the next maximum 17. In the representations in the Figures, the circumferential direction 18 looking in the striking direction 7 is shown counterclockwise. From the maximum of 17 and running in the striking direction 7, the deflection of the rib 13 decreases continuously in the circumferential direction 18 to the next minimum 16. The deflection that is tangential to the axis 2 changes, for example, sinusoidally along the axis 2.

When the chisel has penetrated into a substrate 1, the minima 16 exercise a force contrary to the circumferential direction 18, while the maxima exercise a force on the substrate 1 in the circumferential direction 18. The resulting shearing forces reduce the tendency of the chisel 1 that has penetrated deep into the substrate to jam or become stuck in the substrate.

In some embodiments, the mean deflection of the rib 13 is may be equal to zero, while the deflections in the circumferential direction 18, and the deflections contrary to the circumferential direction 18 may be of equal magnitude. The minima 16 of a rib 13 are all aligned along the axis 2. The minima 16 of a rib 13 are offset with respect to one another along the axis 2, but otherwise have the same angular position 19 with respect to the axis 2. Equally preferably, all maxima 17 of the rib 13 are aligned along the axis 2 at an angular position 20. The symmetrical design favors a uniform transfer of forces in and contrary to the circumferential direction 18 as well as improved performance in terms of not jamming of the chisel 1 in the substrate. In some embodiments, the extrema 16, 17 may be at a constant distance 21 along the axis 2. The ribs 13 are thus mirror-symmetrical over a longer section to a plane that is perpendicular to the axis 2, e.g., one of the planes II-II, or IV-IV, which extends through one of the minima 16 or the maxima 17.

According to some exemplary embodiments, the number of ribs 13 provided is, as an example, between three ribs 13 for a narrow chisel 1 and six ribs 13 for a thick chisel 1. The ribs 13 may be distributed uniformly around the axis 2 to provide a rotationally symmetrical structure, so that the forces are equal in and contrary to the circumferential direction 18. The ribs 13 may all have the same shape as shown, resulting in the structure shown by way of example of four-fold rotational symmetry. Alternatively, for example, in the case of four ribs, diametrically-opposed ribs may be shaped the same but shaped differently from their adjacent ribs. The rotational symmetry is thus only two-fold with four ribs.

In some embodiments, the ribs 13 of the spreading element 12 each have three minima 16 and three maxima 17, i.e., three wave trains 22. The number of extrema 17, 16 depends on the length 14 of the spreading element 12. According to some embodiments, a distance 21 from one extremum 16, 17 to the next extremum 17, 16 may be in the range of about 1 cm to about 3 cm. A chisel 1 typically penetrates a substrate up to 10 cm, and with more than one wave train 22.

According to some embodiments, the rib 13 has a back 23 and has a first flank bordering the back 23 contrary to a circumferential direction 18, and a second flank bordering the back 23 in the circumferential direction 18. A surface of the rib 13 is composed largely of a first side surface 24 in the circumferential direction 18, the back 23 and a second side surface 25 contrary to the circumferential direction 18. In some embodiments, the first side surface 24 only faces in the circumferential direction 18. In at least some embodiments, the first side surface 24 is only inclined in the direction of the axis 2 in the circumferential direction 18. The first side surface 24 may be continuous and may extend over the entire axial dimension 14 of the rib 13. As a counterpart to the first side surface 24, In some embodiments the second side surface 25 only faces contrary to the circumferential direction 18. Further, in some embodiments, the second side surface 25 increases everywhere in the circumferential direction 18, i.e., away from the axis 2. In the same manner as the first side surface 24, the second side surface 25 may extend along the entire length 14 of the rib 13 and may be continuous.

The second side surface 25 extends along the axis 2, preferably parallel to the first side surface 24. In some embodiments, a curvature in the striking direction 7 of the first side surface 24 may be equal to the curvature in the striking direction 7 of the second side surface 25. In some embodiments, a width 26 of the rib 13 may be constant along the axis 2. In some embodiments, the width 26 can be determined quantitatively as half the height 27 of rib 13. The half-height 27 is half of the radial distance between the back 23 and the foot 28 or half of the arithmetic mean of the outer diameter 29 and the inner diameter 30. The coverage of the circumference by the plurality of ribs 13 is located within an angular arc between 90 degrees and 150 degrees at the half height 27. In some embodiments, the width 26 of the ribs 13 at the spreading element 12 in the case of four ribs 13, is located within an angular arc between about 22.5 degrees and about 37.5 degrees.

In some embodiments the rib 13 has a mirror-symmetric profile. The cross-sections of the rib 13 perpendicular to the axis 2 are in mirror symmetry with respect to a mirror axis 31 passing through the back 23. From the back 23 and extending in the radial direction, a curvature in the radial direction of the first side surface 24 is in mirror symmetry with respect to the (negative) curvature in the radial direction of the second side surface 25.

The back 23 may be flat or, as shown in the illustrated example, linear. The back 23 is tangential to the circumferential direction 18. The two side surfaces 24, 25 bordering the back 23 may decrease from the back 23 in the direction of the axis 2, in or contrary to the circumferential direction 18. The back 23 is composed of the points on the surface of the rib 13, which present the largest radial distance from the axis 2 in the planes perpendicular to the axis 2. In some embodiments, a gap of the back 23 with respect to the axis 2 decreases, preferably continuously along the striking direction 7, while the back 23 monotonically increases with respect to the axis 2 in particular in the area of the tip 3. Alternatively, the gap of the back 23 may periodically increase and decrease along the axis 2. The points of the surface next nearest to the axis 2 form a foot 28 of the rib 13. A gap 30 of the foot 28 with respect to the axis 2 may be constant over the entire length 14 of the spreading element 12. The foot 28 of a rib 13 may merge into the foot 28 of an adjacent rib 13 in a circumferential direction 18.

The ribs 13 arranged around the axis 2 characterize a non-convex shape of the spreading element 12. The side surfaces 24, 25 that are recessed with respect to the back 23 in the radial direction border the passages 32 extending between the ribs 13. The passages 32 are located within a convex envelope of the spreading element 12. The chisel has an outer diameter 29, which equal to twice the distance of the back 23 from the axis 2, and an inner diameter 30, which is equal to twice the distance of the foot 28 from the axis 2 of the spreading element 12. In some embodiments, the outer diameter 29 may be on the order of at least 50% larger than an inner diameter 30. The ribs 13 may extend radially from a core 33. In some embodiments, the core 33 is a convex solid body, e.g., a rotary body or cylinder that is concentric to the axis 2.

The first side surface 24 may be wave-shaped corresponding to the rib 13. In some embodiments, an angle 34 between the first side surface 24 and the axis 2 changes alternately along the axis 2. The angle 34 increases particularly at negative and positive values, whereby the design differs significantly from a spiral with a constant angle and a fixed direction of rotation. For example, the angle 34 may change sinusoidally along the axis 2. In some embodiments, the maximum value of the angle 34 lies between approximately 3 degrees and approximately 20 degrees, while the minimum value lies between approximately −3 degrees and approximately −20 degrees.

In some embodiments, the first side surface 24 is divided along the axis 2 alternately between successive first sections 35 and second sections 36. The first side surface 25 is inclined in the first sections 35 at a positive angle 34 with respect to the axis 2. The first side surfaces 25 subsequently increase in the striking direction 7 in the circumferential direction 18. The first side surfaces 25 that are inclined in the first sections 35 and their perpendiculars 37 run in the striking direction 7. The second sections 36 run counter to the first sections 35. The first side surface 24 assumes a negative angle 34 with respect to the axis 2. The first side surface 24 runs contrary to the circumferential direction 18 along the striking direction 7. The first side surfaces 24 and their perpendiculars 38 run opposite to the striking direction 7 with respect to the striking face 4.

The tangential deflection of the rib 13 is effected, for example, by a parallel offset. The first side surface 24 is parallel at a minimum 16 to itself at a maximum 17, and preferably to all other cross-sections that are perpendicular to the axis 2. The inclination 34 of the first side surface 24 with respect to the axis 2 repeatedly varies along the axis 2, but is constant in the radial direction. In the case of a mirror-symmetrical rib 13, different mirror axes 31 are mutually parallel to one another along the axis 2. The parallel offset, for example, can take place along a straight line 39 that is perpendicular to the axis 2 and tangential to a point on the back 23 of the rib 13. The point can be, for example, in the center 40 (plane III-III) between a minimum 16 and a maximum 17.

Each of the ribs 13 is assigned its own straight line 39, which is equal to the angle 15 between the ribs 13 that are also arranged at this angle 15 about the axis 2. Parallel offset is provided for the different ribs 13, whereby the direction of each is rotated through the angle 15. The profile of the spreading element 12 may vary along the axis 2. For example, the cross-sections through the spreading element 12 at the minima 16, the center 40 and the maxima 17 may differ in their shape. The cross-sections cannot be brought into alignment with one another by a rotation about the axis 2. The cross-section in the center 40, for example, is in mirror symmetry to the mirror axis 31. On the other hand, the cross-sections through the minima 16 and the maxima 17 are not in mirror symmetry, but may be configured to be mirror symmetrical with respect to one another.

The amplitude of the tangential deflection of the rib 13 is limited. FIG. 4 shows a cross-section through the minimum 16 in addition to the cross-section through the maximum 17. In particular, none of the ribs 13 cross. In some embodiments, the amplitude of the deflection between two adjacent extrema 16, 17 is at most sufficiently large so that an overlapping area 41 of the cross-section through the rib 13, in which one of the extremes 16, e.g., minimum, and the cross-section through the same rib 13 of the other extreme 17, e.g., maximum, represents at least a predetermined percentage, e.g., at least 25%, of the cross-sectional area of the rib 13. Whereby, the good trapezoidal approximation cross-section of the ribs 13 results in a deflection amplitude, i.e. the distance from minimum 16 to maximum 17, of less than a predetermined percentage, e.g., 75%, of the width 26 of the rib 13. In some embodiments, the amplitude is at least sufficiently large so that the area of overlap 41 (cross-hatching) of the cross-sections of the rib 13 in the minimum of 16 and the maximum 17 is less than a predetermined percentage, e.g., 75%, of the cross-sectional area of the rib 13. Accordingly, the amplitude is a predetermined percentage, e.g., approximately 25%, of the width 26 of the rib 13.

In some embodiments, the amplitude expressed as angular offset 42 in and contrary to the circumferential direction 18 between the maxima 17 and neighboring minima 16 may be less than about 30 degrees and greater than about 5 degrees. In some embodiments, the ribs 13 within the first section 35 may be at least about 5 degrees and less than about one-twelfth of a revolution in the circumferential direction 18 in order that the immediately subsequent second section 36 runs at least about 5 degrees contrary to the circumferential direction 18. Rotation in the opposite direction in the second section 36 may also restricted to one twelfth of a revolution. In some embodiments, the passages 32 between the ribs 13 have a core 43 with a width of at least about 30 degrees running in a straight line along the axis 2. The angular dimensions are preferably determined based on a contour line at mid-height 27 of the ribs 13.

Figure 7:
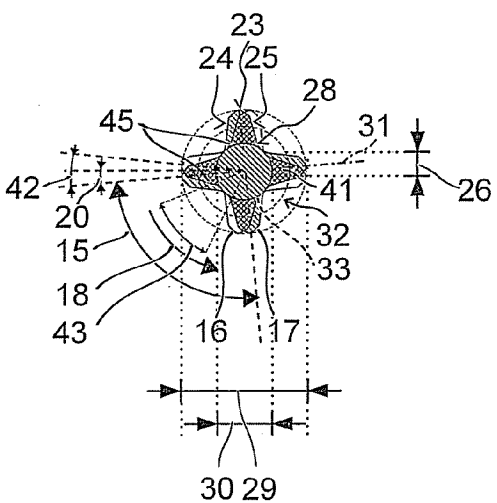
FIGS. 5, 6 and 7 show cross-sections through a chisel.
Figure 6:
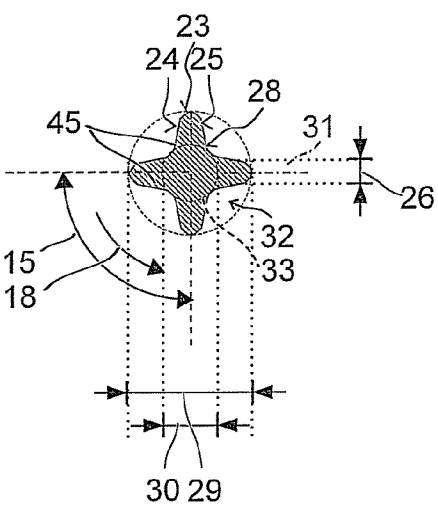
Figure 5:
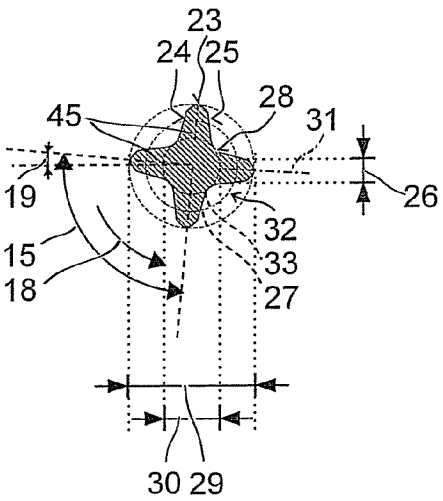

FIGS. 5 to 7 show cross-sections through a spreading element 12. FIG. 5 extends through a minimum deflection corresponding to the plane II-II, FIG. 7 through a maximum deflection corresponding to the plane Iv-Iv and FIG. 6 through a plane in the middle between the maximum and the minimum corresponding to the plane III-III.

The spreading element 44 has a plurality of ribs 45, which are arranged around the axis 2. The ribs 45 extending along the axis 2 may be wave-shaped, whereby the deflection is tangential to the axis 2. The ribs 45 each have a continuous first side surface 24 which only faces in the circumferential direction 18, and a continuous second side surface 25 which faces away from the circumferential direction 18. In some embodiments, the surface of the rib 45 is formed by the side surfaces 24, 25 that may be parallel to one another. For further details of the ribs 45, reference is made to the descriptions of FIG. 2 to FIG. 4.

The rib 45 is wound around the axis 2. The tangential deflection is effected by a rotation of the rib 45 about the axis 2. Cross-sections perpendicular to the axis 2 through the spreading element 12 have the same shape; they can be brought within the overlap by rotation about the axis 2. The cross-section can, for example, be in mirror symmetry to the mirror axes 31 of the ribs 45.

The amplitude of the tangential deflection of the rib 45 is limited. FIG. 7 shows, in addition to the cross-section through the maximum 17 (cross-hatched), a cross-section through the minimum 16 (not cross-hatched). In some embodiments, the angular offset 42 between the minimum 16 and the maximum 17 is less than about 30 degrees and greater than about 5 degrees. In some embodiments, the angular offset 42 may be of an equal magnitude between all extrema 16, 17 (see FIG. 1).

In some embodiments, a width 26 of the rib 45 is preferably greater than the angular offset 42. The width 26 of the rib 45 is, for example, selected such that the ribs 45 cover an angular arc between 90 degrees and 150 degrees of the circumference at mid-height 27. In the exemplary spreading element 12 with four ribs 45, the width 26 lies between about 22.5 degrees and about 37.5 degrees. The tangential deflection of the width 46 of the ribs 45 may be adapted so that the ribs 45 do not cross one another.

In some embodiments, the angle 34 between the first side surface 24 and the axis 2 increases in the radial direction to the back 23.

Figure 8:
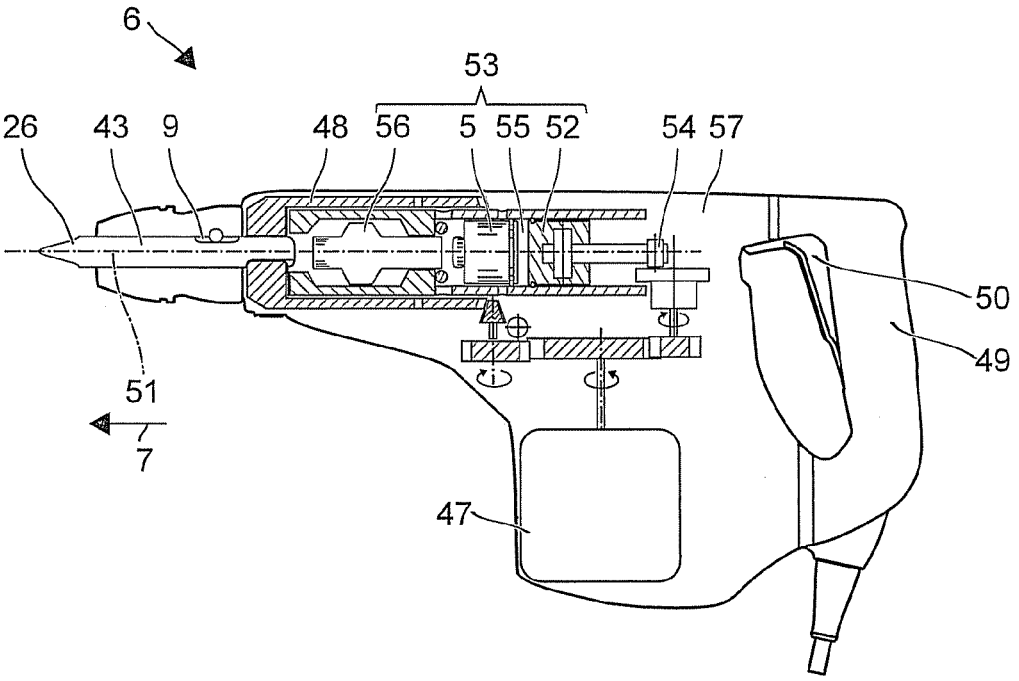
FIG. 8 shows a hammer drill.

FIG. 8 shows schematically an example of a hand-held chisel hammer tool 6. The hammer drill 6 has a tool holder 47 into which a shank 9 of the chisel 1 can be inserted. A primary drive of the hammer drill 6 is in the form of a motor 48, which drives a striking mechanism 49, and a driven shaft 50. A user can guide the hammer drill 6 by means of a handle 51 and can switch the hammer drill 6 on by means of a system switch 52. In operation, the hammer drill 6 strikes the drill chisel 53 into a substrate in the striking direction 7 along the working axis 54.

The striking mechanism 49 may, for example, be a pneumatic hammer mechanism 49. An exciter 55 and a striker 5 are arranged to be movable in the striking mechanism 49 and guided along the working axis 54. The exciter 55 is coupled via a cam 56 or a swashplate to the motor 48 and the force is translated into a periodic, linear motion. An air spring formed by a pneumatic chamber 57 between the exciter 55 and the striker 5 couples the movement of the striker 5 to the movement of the exciter 55. The striker 5 can directly strike a rear end of the chisel 1 or transfer a part of its momentum indirectly to the drill chisel 53 via a substantially stationary intermediate striking element 58.

The striking mechanism 49, and preferably the other drive components may be arranged within a machine housing 59.

The invention claimed is:

1. A chisel having an axis in a striking direction, the chisel comprising: a striking surface' a shank; a spreading element; and a tip; wherein the striking surface, shank, spreading element and tip are arranged successively along the axis; wherein the spreading element has ribs, spaced radially apart from each other about the axis, extending longitudinally along the axis and, wherein each rib has a wave shape formed with a deflection in a circumferential direction around the axis.

2. A chisel according to claim 1, wherein the chisel has an amplitude of the deflection that is less than a width of the rib.

3. A chisel according to claim 2, wherein the amplitude of the deflection lies between 5 degrees and 30 degrees.

4. A chisel according to claim 1, wherein an amplitude of the deflection in the circumferential direction is equal to an amplitude of the deflection contrary to the circumferential direction.

5. A chisel according to claim 4, wherein the amplitude of the deflection lies between about 5 degrees and about 30 degrees.

6. A chisel according to claim 1, wherein at least one of the ribs is deflected parallel to itself in the circumferential direction through the wave-shaped deflection about the axis.

7. A chisel according to claim 6, wherein a shape of a cross-section of the spreading element including the ribs vertical to the axis changes continuously along the axis with rotation.

8. A chisel according to claim 1, wherein the chisel has at least two wave trains.

9. A chisel according claim 1, wherein the rib is inclined with respect to the axis by a periodically changing angle along the axis, while a smallest value of the angle lies between about −20 degrees and about −3 degrees while a largest value of the angle lies between about 3 degrees and about 20 degrees.

10. A chisel having an axis in a striking direction, the chisel comprising: a striking surface, a shank, a spreading element and a tip arranged successively along the axis, the spreading element having ribs extending longitudinally along the axis and spaced radially apart from each other about the axis, each rib having a wave shape formed with a deflection in a circumferential direction around the axis; wherein an amplitude of the deflection in a circumferential direction is equal to an amplitude of the deflection contrary to the circumferential direction; and wherein at least one of the ribs is deflected parallel to itself in the circumferential direction through the wave-shaped deflection about the axis.

11. A chisel according to claim 10, wherein the amplitude of the deflection lies between about 5 degrees and about 30 degrees.

12. A chisel according to claim 10, wherein a shape of a cross-section of the spreading element including the ribs vertical to the axis changes continuously along the axis.

13. A chisel according to claim 10, wherein the chisel has at least two wave trains.

14. A chisel according claim 10, wherein the rib is inclined with respect to the axis by a periodically changing angle along the axis, while a smallest value of the angle lies between about −20 degrees and about −3 degrees while a largest value of the angle lies between about 3 degrees and about 20 degrees.

15. A chisel according to claim 1, wherein the chisel is for use in a power tool.

16. A chisel according to claim 10, wherein the chisel is for use in a power tool.

17. A chisel according to claim 1, wherein the spreading element is constructed from the same material as the tip.

18. A chisel according to claim 10, wherein the spreading element is constructed from the same material as the tip.

19. A chisel according to claim 1, wherein the ribs are in uniform angular arrangement from the axis.

20. A chisel according to claim 1, wherein the ribs are a uniform distance from the axis.

21. A chisel according to claim 1, wherein the spreading element has alternating first and second sections along the axis wherein the first sections have a helical shape with rotation in the circumferential direction and the second sections have a helical shape with rotation in a second circumferential direction.

* * * * *